US007744452B2

(12) United States Patent
Cimring et al.

(10) Patent No.: US 7,744,452 B2
(45) Date of Patent: Jun. 29, 2010

(54) CONCURRENT GAMING APPARATUS AND METHOD

(75) Inventors: Daniel Gary Cimring, Umdloti (ZA); Martin Moshal, Marina Bay (GI)

(73) Assignee: Waterleaf Limited, Douglas, Isle of Man (GB)

( * ) Notice: Subject to any disclaimer, the term of this patent is extended or adjusted under 35 U.S.C. 154(b) by 1067 days.

(21) Appl. No.: 10/492,112

(22) PCT Filed: Oct. 4, 2002

(86) PCT No.: PCT/IB02/04072

§ 371 (c)(1),
(2), (4) Date: Sep. 13, 2004

(87) PCT Pub. No.: WO03/034358

PCT Pub. Date: Apr. 24, 2003

(65) Prior Publication Data

US 2005/0020339 A1 Jan. 27, 2005
US 2005/0176487 A2 Aug. 11, 2005

(30) Foreign Application Priority Data

Oct. 11, 2001 (GB) ..... 0124447.4

(51) Int. Cl.
*A63F 1/00* (2006.01)
*A63F 13/00* (2006.01)
*G06F 19/00* (2006.01)

(52) U.S. Cl. ..... 463/13; 463/42; 273/274; 273/292

(58) Field of Classification Search ..... 273/274, 273/292; 463/13, 42
See application file for complete search history.

(56) References Cited

U.S. PATENT DOCUMENTS 4,760,527 A * 7/1988 Sidley ..... 463/13

(Continued)

FOREIGN PATENT DOCUMENTS

WO WO 00/40313 7/2000

OTHER PUBLICATIONS

Examiner's first report, dated Sep. 17, 2007, from related Australian patent application No. 2002343113.

*Primary Examiner*—Scott Jones
*Assistant Examiner*—William H McCulloch
(74) *Attorney, Agent, or Firm*—McDonnell Boehnen Hulbert & Berghoff, LLP

(57) ABSTRACT

A system for concurrent gaming comprises a gaming server and a client computer connected to the gaming server by means of an open communication network. The gaming server is instructable by the client to randomly select multiple, concurrent hands of playing cards to a player in a turn of a game of Caribbean Stud poker. The compositions of the multiple, randomly selected concurrent hands is transmitted by the gaming server along the communication network to the client computer where they are displayed to the player, under program control as part of a simulation of the game of Caribbean Stud poker. Gaming server also generates the gaming server also randomly selects a hand associated with a dealer in the game, the composition of the dealer's hand being also transmitted by the gaming server to the client computer and displayed as part of the simulation. The player then makes desired game play decisions, in turn, as a function of each one of the, multiple concurrent hands and the dealer's hand.

16 Claims, 5 Drawing Sheets

U.S. PATENT DOCUMENTS 4,836,553 A * 6/1989 Suttle et al. ..... 273/292
4,948,134 A * 8/1990 Suttle et al. ..... 463/13
5,022,653 A * 6/1991 Suttle et al. ..... 463/13
5,042,818 A * 8/1991 Weingardt ..... 463/13
5,356,140 A * 10/1994 Dabrowski et al. ..... 463/12
5,707,287 A * 1/1998 McCrea, Jr. ..... 463/27
5,732,950 A * 3/1998 Moody ..... 273/292
5,816,915 A * 10/1998 Kadlic ..... 463/13
5,851,011 A * 12/1998 Lott ..... 273/292
5,851,148 A 12/1998 Brune et al.
5,911,419 A * 6/1999 Delaney et al. ..... 273/292
6,007,426 A * 12/1999 Kelly et al. ..... 463/16
6,065,752 A * 5/2000 Beltran ..... 273/274
6,098,985 A * 8/2000 Moody ..... 273/292
6,129,357 A * 10/2000 Wichinsky ..... 273/292
6,132,311 A * 10/2000 Williams ..... 463/13
6,135,882 A * 10/2000 Kadlic ..... 463/13
6,146,271 A * 11/2000 Kadlic ..... 463/13
6,203,428 B1 * 3/2001 Giobbi et al. ..... 463/16
6,227,969 B1 * 5/2001 Yoseloff ..... 463/13
6,332,614 B1 * 12/2001 Hesse ..... 273/292
6,382,628 B2 * 5/2002 Stern ..... 273/292
6,398,645 B1 * 6/2002 Yoseloff ..... 463/19
6,446,972 B1 * 9/2002 Brunelle ..... 273/292
6,511,068 B1 * 1/2003 Sklansky et al. ..... 273/237
6,755,741 B1 * 6/2004 Rafaeli ..... 463/25
6,964,418 B2 * 11/2005 Moody ..... 273/292
2001/0046890 A1 * 11/2001 Ferguson ..... 463/13
2001/0052671 A1 * 12/2001 Stern ..... 273/292
2002/0008356 A1 * 1/2002 De Keller ..... 273/292
2002/0103029 A1 * 8/2002 Finlayson et al. ..... 463/42
2003/0008697 A1 * 1/2003 Hartl ..... 463/11
2003/0064767 A1 * 4/2003 Brown ..... 463/12
2005/0020339 A1 * 1/2005 Cimring et al. ..... 463/13
2005/0176487 A2 * 8/2005 Cimring et al. ..... 463/13

* cited by examiner

CONCURRENT GAMING APPARATUS AND METHOD

FIELD OF THE INVENTION

This invention relates to an apparatus for concurrent gaming, more particularly, to an apparatus for concurrently playing a game of chance and, more specifically, to an apparatus for playing a variation of a game of poker. The invention extends to a method for concurrent gaming.

BACKGROUND TO THE INVENTION

A well-known variation of the game of poker is called Caribbean Stud.

This game is a game of poker between each one of a number players and a dealer. During a turn of the game, each player is required to make an initial wager called an ante. After wagering the ante, each player and the dealer receive five cards dealt from a single deck of 52 playing cards. The playing cards are dealt to each player face down, while the dealer receives one card face up and the remainder face down. Each player must not, at this stage, disclose the playing cards that have been dealt to him.

Each player is then required to decide, on the basis of the playing cards which have been dealt to him, and the dealer's exposed playing card, whether to continue with his participation in this turn of the game (that is, to "play") or to terminate his participation in the turn (that is, to "fold"). If a player folds, he loses his ante wager. If a player decides to play, he must make a further wager, known as the main wager, which is equal to twice the amount of the ante wager.

Once the main wager has been made in this manner by all players who have decided to play in the particular turn of the game, the dealer and the players all reveal their hands. In order to participate in the game (that is, "to qualify") is, the dealer's hand must contain an Ace and a King, or better, in a conventional ranking of poker hands. If the dealer does not qualify, each player who has not folded wins the ante wager at even money and has the main wager is returned to him. If the dealer qualifies, the dealer's hand is compared to that of each player. If a player has a better poker hand than that of the dealer, the player wins the ante bet at even money and wins the main bet according to a predetermined table of odds. If a player has a worse poker hand than that of the dealer, both the ante wager and the main wager are lost.

A problem with this game of Caribbean Stud is that each player may only play one hand at the time. The reason for this is that if more than one hand was to be played, a player could swap playing cards between the two or more hands, thereby gaining an advantage over the dealer. Even in the absence of cards swapping, a player could, potentially, gain an advantage by playing multiple hands and adjusting his playing strategy in accordance with a collective knowledge of the playing cards in the multiple hands that have been dealt to him in a particular turn of the game.

OBJECT OF THE INVENTION

It is an object of this invention to provide an apparatus for concurrent gaming and a method for concurrent gaming that will, at least partially, alleviate the above-mentioned difficulties and disadvantages whilst allowing a player to play multiple simultaneous hands of Caribbean Stud.

SUMMARY OF THE INVENTION

In accordance with this invention there is provided a method for concurrent gaming, which includes the step of:

dealing multiple concurrent hands of playing cards to a player in a turn of a game of Caribbean Stud poker, wherein each one of the multiple concurrent hands of playing cards is dealt from a separate deck of playing cards, each of the separate decks of playing cards having an identical composition.

Further features of the invention provide for each one of the separate decks of playing cards to be a single deck of cards, preferably 52 in number, and for each one of the concurrent hands to be a poker hand consisting of five dealt playing cards.

Still further features of the invention provide for the method to also include the step of dealing a further hand of playing cards associated with a dealer, for the further hand of playing cards associated with the dealer to be dealt from a further separate deck of playing cards, for dealing the further hand of playing cards associated with the dealer prior to dealing the multiple concurrent hands of playing cards to the player, and for removing from each of the separate decks of playing cards those cards contained in the dealer's hand prior to dealing the multiple concurrent hands to the player.

Yet further features of the invention provide for the method to include the still further step of dealing multiple concurrent hands of playing cards to each one of a plurality of different players in a manner as described above.

The invention extends to a method of operating a gaming server, comprising the steps of:

randomly selecting multiple concurrent hands of playing cards for a player playing a turn of a game of Caribbean Stud poker, wherein each one of the multiple concurrent hands of playing cards is randomly selected from a separate deck of playing cards, each of the separate decks of playing cards having an identical composition;

and transmitting, along a communication network, a signal containing data representative of the composition of the selected multiple concurrent hands.

There is further provided for each one of the separate decks of playing cards to be a single deck of cards, preferably 52 at most, and for each one of the concurrent hands to be a poker hand consisting of five randomly selected playing cards.

There is still further provided for randomly selecting a further hand of playing cards associated with a dealer, for transmitting, along the communication network, a signal containing data representative of the composition of the randomly selected further hand, for randomly selecting the further hand of playing cards associated with the dealer from a further separate deck of playing cards, for randomly selecting the further hand of playing cards associated with the dealer prior to randomly selecting the multiple concurrent hands of playing cards for the player, and for removing, from each of the separate decks of playing cards, the cards contained in the dealer's hand prior to randomly selecting the multiple concurrent hands of playing cards for the player.

There is yet further provided for randomly selecting multiple concurrent hands of playing cards for each one of a plurality of different players in a manner as described above.

The invention extends further to a method of operating a client computer, comprising the steps of:

transmitting, along a communication network, a request to a gaming server, to randomly select multiple concurrent hands of playing cards for a player playing a turn of a game of Caribbean Stud poker, wherein each one of the multiple concurrent hands of playing cards is randomly selected from a separate deck of playing cards, each of the separate decks of playing cards having an identical composition;

receiving, along the communication network, a response from the gaming server containing data representative of the composition of the selected multiple concurrent hands;

and displaying the selected multiple concurrent hands as part of a simulation of the game of Caribbean Stud poker.

There is also provided for requesting the gaming server to randomly select a further hand of playing cards associated with a dealer, wherein the further hand is randomly selected from a further separate deck of playing cards, receiving a response from the gaming server containing data representative of the composition of the further hand of playing cards associated with the dealer, and displaying the further hand as part of the simulation of the game.

The invention extends still further to a system for concurrent gaming, comprising:

dealing means instructable to deal multiple concurrent hands of playing cards to a player in a turn of a game of Caribbean Stud poker, wherein each one of the multiple concurrent hands of playing cards is dealt from a separate deck of playing cards, each of the separate decks of playing cards having an identical composition; and a player terminal responsive to the dealing means to display the multiple concurrent dealt hands.

There is also provided for each one of the separate decks of playing cards to be a single deck of playing cards, preferably 52 in number, and for each one of the concurrent hands to be a poker hand consisting of five dealt playing cards.

There is also provided for the dealing means to also deal a further hand of playing cards associated with a dealer, for the dealing means to deal the further hand of playing cards associated with the dealer from a further separate deck of playing cards, for the dealing means to deal the further hand of playing cards associated with the dealer prior to dealing the multiple concurrent hands of playing cards to the player, and for the dealing means to remove from each of the separate decks of playing cards those cards contained in the dealer's hand prior to dealing the multiple concurrent hands to the player.

There is also provided for the dealing means to deal multiple concurrent hands of playing cards to each one of a plurality of different players in a manner as described above.

The invention extends yet further to a computer generated message containing data representative of the composition of multiple, randomly selected, concurrent hands of playing cards for a player playing a turn of a game of Caribbean Stud poker, wherein each one of the multiple concurrent hands of playing cards is randomly selected from a separate deck of playing cards, each of the separate decks of playing cards having an identical composition.

BRIEF DESCRIPTION OF THE DRAWINGS

A preferred embodiment of the invention is described below, by way of example only, and with reference to the accompanying drawings, in which.

DETAILED DESCRIPTION OF THE INVENTION

Figure 1:
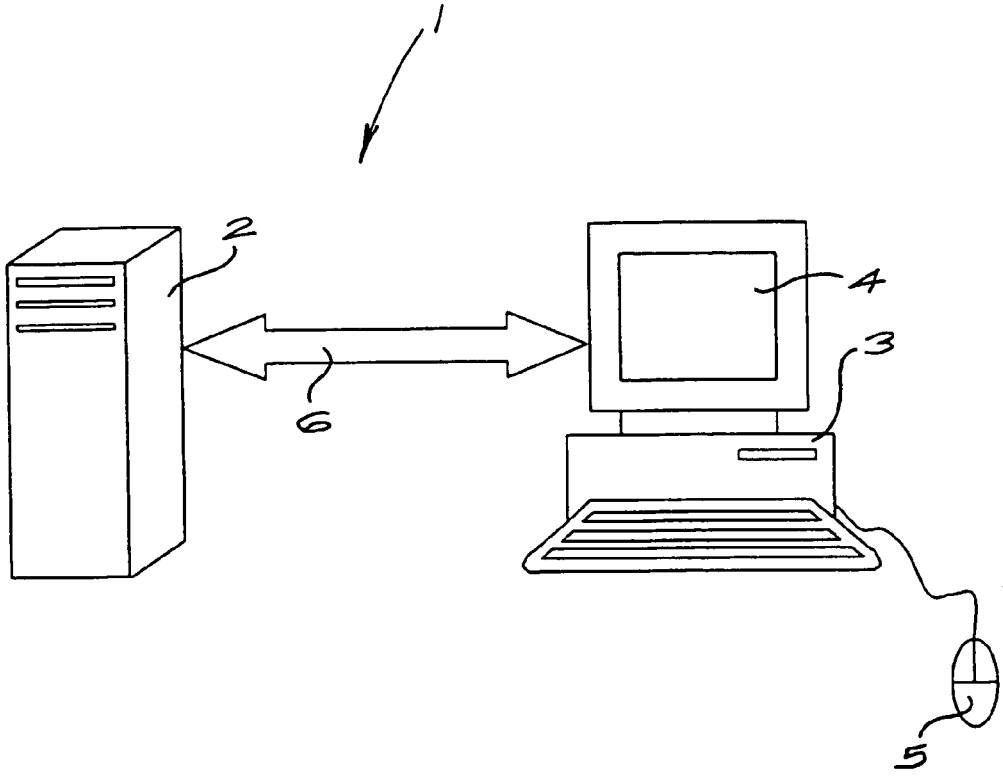
FIG. 1 is a functional representation of a system for playing a game of chance, according to the invention.
Figure 2:
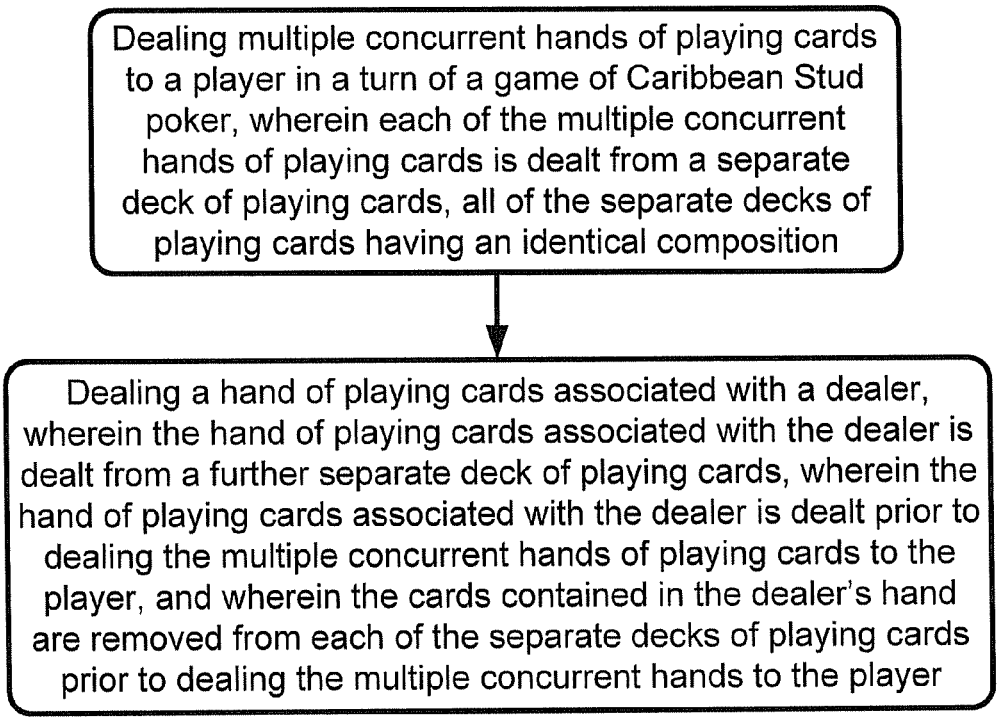
FIG. 2 is a flowchart depicting a set of functions in accordance with an exemplary embodiment.
Figure 3:
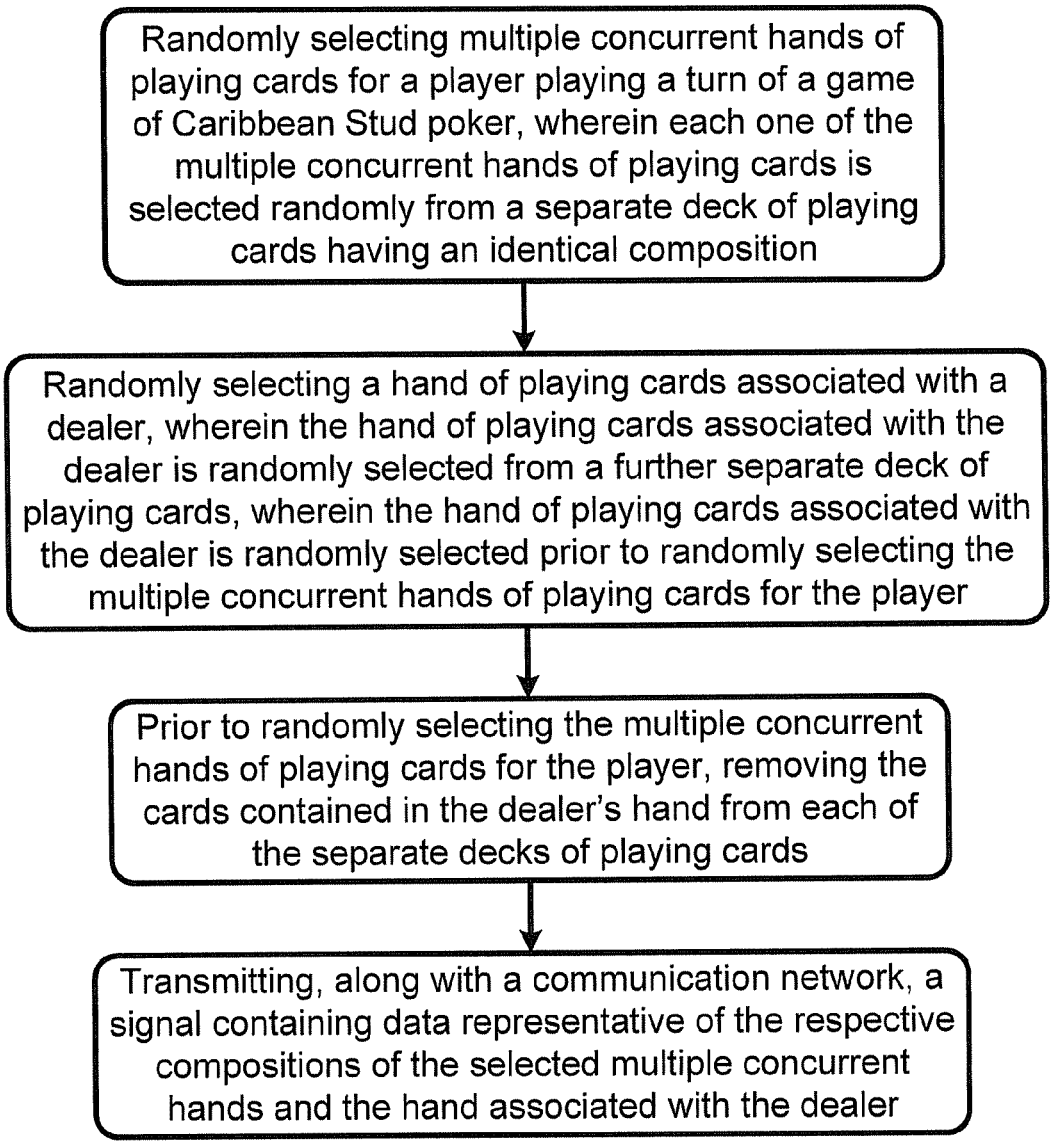
FIG. 3 is a flowchart depicting a set of functions in accordance with another exemplary embodiment.
Figure 4:
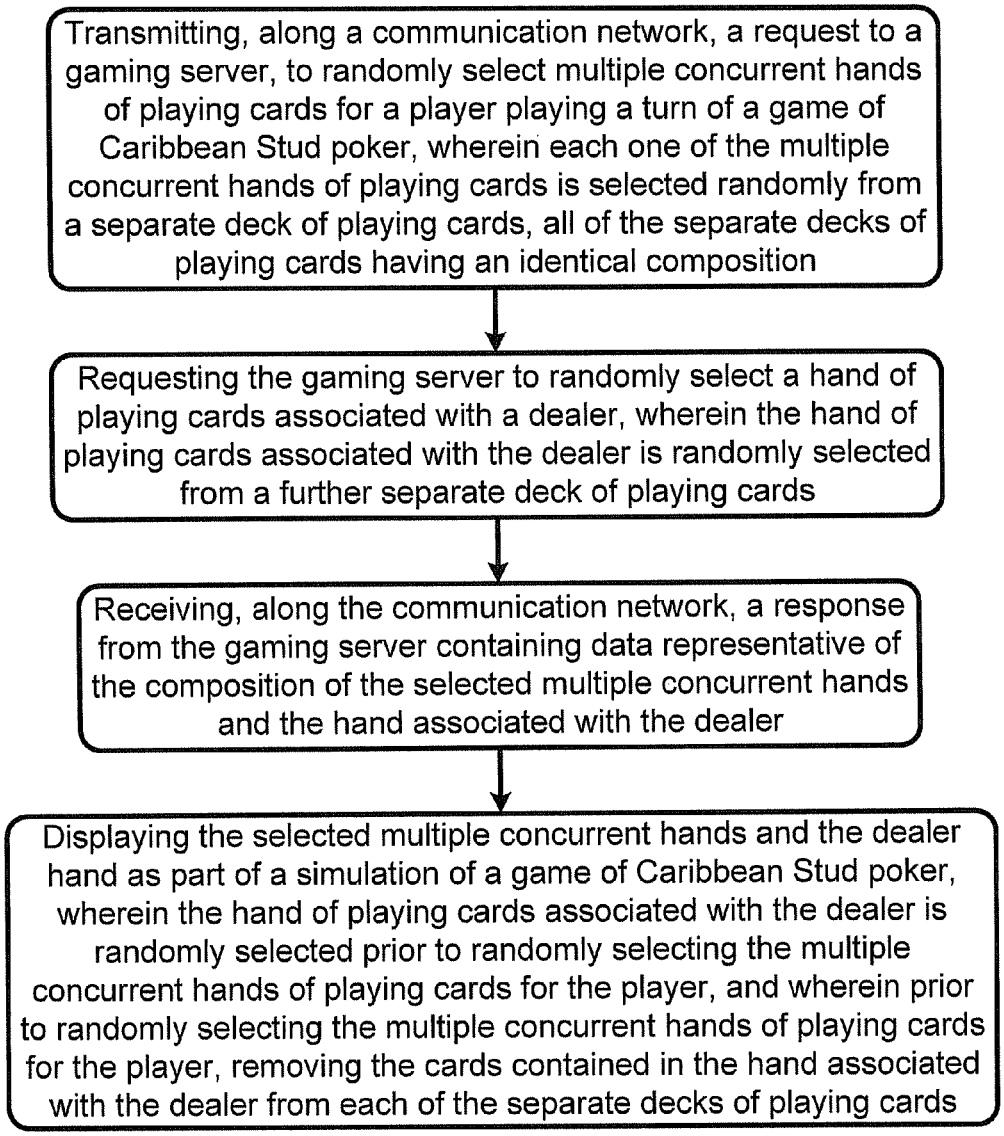
FIG. 4 is a flowchart depicting a set of functions in accordance with another exemplary embodiment.
Figure 5:
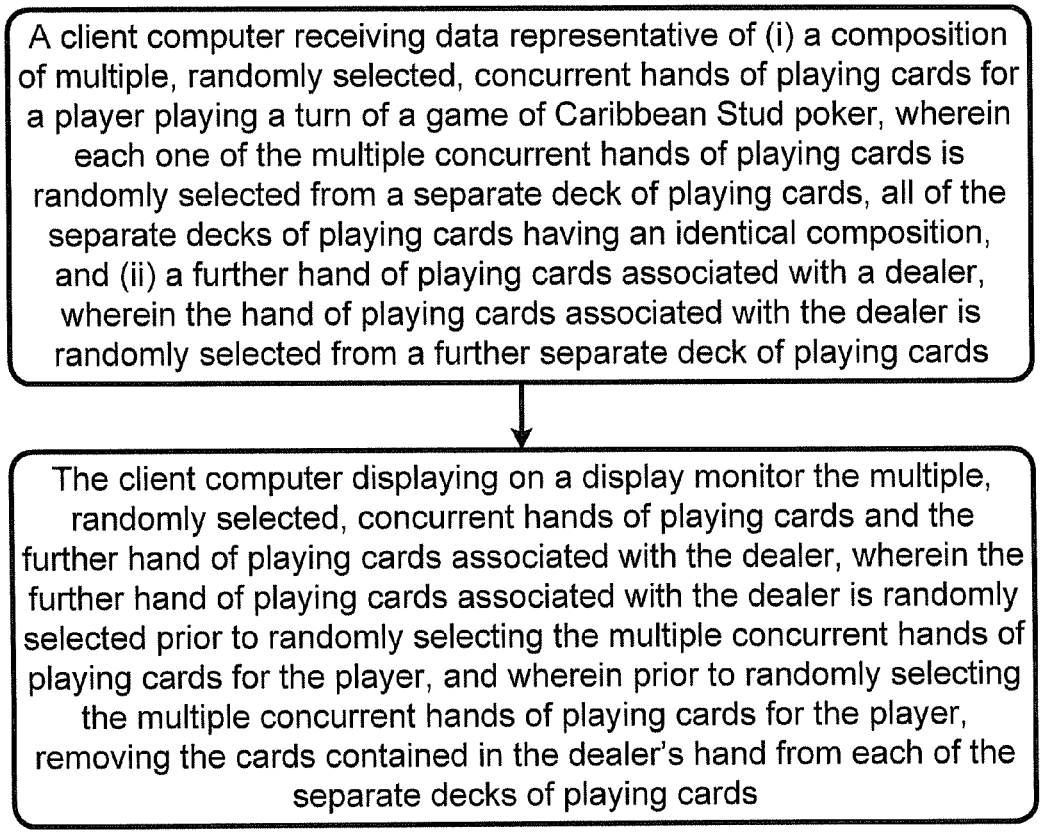
FIG. 5 is a flowchart depicting a set of functions in accordance with another exemplary embodiment.

An embodiment of the invention for playing a game of chance includes means for placing a wager on an outcome of a turn of a game of Caribbean Stud poker, in the form of a playing surface having multiple bet placement locations enabling a player to place separate wagers on an outcome of each one of multiple simultaneous hands of the game of Caribbean Stud poker. In this particular embodiment, the playing surface has five bet placement locations enabling the player to place wagers on up to five simultaneous hands of the game. The bet placement locations are arranged in a substantially arcuate configuration, similar to the layout of bet placement locations on a table in a conventional game of blackjack.

In a turn of the game, a player is able to make an ante wager on any one or more of the bet placement locations on the playing surface. The player is not required to place an ante wager on all of the bet placement locations on the playing surface.

One the player has placed one or more ante wagers as described above, the player is dealt a separate hand of playing cards corresponding to each one of the bet placement locations on which he has placed an ante wager. Each such separate hand consists of five playing cards dealt from a complete conventional deck of 52 laying cards. A further hand of five playing cards is dealt to a dealer representing a "house". A first one of the cards in the dealer's hand is dealt face up, while the remaining four cards are dealt face down. It is an essential aspect of this invention that each one of the hands dealt to the player that corresponds to a bet placement location, as well as the dealer's hand, is dealt from a separate, complete deck of 52 playing cards.

Once the player's and the dealer's hands have been dealt in this manner, the player is required to decide, in turn, in respect of each one of his dealt hands, whether to continue with his participation in, or to withdraw from, the turn of the game of Caribbean Stud poker, that is, to "play" or to "fold" the hand. If the player folds a hand, the ante wager associated with that particular hand is forfeited. If the player decides to play any particular hand, he is required to make a further wager, the main wager, equal to twice the amount of the ante wager associated with that particular game.

When the player has decided whether to play or to fold each of the dealt hands, the dealer's hand is revealed. If the dealer's hand does not qualify, meaning that the dealer's hand does not contain an Ace-King combination, or better, in a conventional poker sense, all of the player's hands that he has not already folded, win for the player the ante wager at even money and a return of the main wager, irrespective of the cards in the hands. If the dealer's hand does indeed qualify, it is compared, separately and in turn, with each one of the player's unfolded hands in order to determine which of the two hands is of higher rank according to conventional poker rankings. Where the dealer and player hands are of equal ranking, conventional rules in respect of tied poker hands apply; namely, the high cards in the dealer and player hands are used as tiebreakers. If the player and dealer hands are thereafter still tied, the entire hand is tied and the ante wager and the main wager are returned to the player. It is possible to obtain identical tied hands since the cards in the dealer's and player's hands are dealt from different complete decks of playing cards.

Where the dealer's hand does qualify and is outranked by the player's hand, the player wins the ante wager at even money, together with odds on the main wager according to the following table:

| | |
|---|---|
| Ace/King | 2 to 1 |
| One Pair | 2 to 1 |
| Two Pair | 2 to 1 |
| Three of a kind | 4 to 1 |
| Straight | 6 to 1 |
| Flush | 10 to 1 |
| Full House | 10 to 1 |
| Four of a kind | 150 to 1 |
| Straight Flush | 250 to 1 |
| Royal Flush | 1000 to 1 |

In a slight variation of this embodiment, the dealer's hand is dealt prior to the multiple hands that are dealt to the player, and the cards in the dealer's hand are removed from each one of the remaining different decks of playing cards prior to dealing the multiple simultaneous hands to the player. In this variation, the possibility of a tie between a player's hand and the dealer's hand is reduced.

In a further slight variation of this embodiment, the playing surface is divided into multiple clusters of bet placement locations, thereby enabling multiple players to each play multiple simultaneous hands of Caribbean Stud poker as described above.

It will be appreciated by those skilled in the art that these embodiments of the invention solve the problem of enabling a player to play multiple simultaneous hands of Caribbean Stud poker. Further, the use of a separate complete deck of playing cards to deal each of the multiple hands of Caribbean Stud prevents a player from gaining an advantage by playing multiple simultaneous hands and adjusting his playing strategy as a function of a collective knowledge of the playing cards that have been dealt to him in the multiple hands in a particular turn of the game. Whilst these are significant advantages of the invention, there remains the problem of card swapping described above. Further, the use of separate physical complete decks of playing cards to deal the multiple hands when the game of Caribbean Stud poker is played as a table game can rapidly become tedious and cause a player to lose interest in the game. In order to overcome this problem, a further embodiment of the invention is described below.

In this embodiment, a system for playing a game of Caribbean Stud poker is indicated generally by reference numeral (1). The system (1) comprises a gaming server (2) and a player terminal (3) in the form of a computer workstation with an associated display monitor (4) and a pointing device (5) such as a mouse, touchpad or a trackball. The computer workstation (3) is located remotely from the gaming server (2) and is connected thereto by means of a communication network (6) that is, in this embodiment, the World Wide Web of the Internet.

The computer workstation (3) is a conventional personal computer operating under a Windows 2000 operating system, which is well known and commercially available from Microsoft Corporation of Seattle, Wash., USA. The computer workstation (3) executes a stored simulation software program that simulates the progress of a game of Caribbean Stud poker. The operation of the simulation program will be described in more detail in the description that follows.

The gaming server (2) includes a computer program for generating random events that determine the progress of the game of Caribbean Stud poker. In particular, the random event generation program is executable on the on the gaming server (2) to "deal", on a random basis, cards that make up hands that are dealt to a player and to a dealer in the game of Caribbean Stud poker. The operation of such a random event generation programs is well known in the art and will not be described here in detail.

A player wishing to play a game of Caribbean Stud poker is first required to register and to create an account on the gaming server (2). The player is then required to pre-fund the account by purchasing credit that will, for convenience, be denominated in this description in "units". The gaming server stores a credit balance corresponding to the player's account at all times.

In order to commence, the player uses the computer workstation (3) to log onto the gaming server (2) and initiates execution of the simulation program, which causes a playing surface having five bet placement locations to be displayed on the monitor (4), each bet placement location representing a hand of Caribbean Stud poker that can be played by the player. An associated bet placement icon is displayed adjacent to each bet placement location. The simulation program also causes a dialogue box to be displayed with information stating that each hand in the game will be dealt from a separate, complete deck of 52 playing cards. The player now enters a betting phase of the game by activating a bet placement icon in order to place an ante wager on a hand to be played. The size of the ante wager is displayed is displayed on the bet placement location. There must be sufficient credit in the player's account to cover any wager that is made. The player may elect to play more than on hand by activating further bet placement icons on the display monitor (4) and making corresponding ante wagers. The player can make ante wagers of differing amounts on each of the bet placement locations that are activated by the player in this manner. Data relating to the size of each such ante wager made by the player is transmitted by the computer workstation (3) across the communication network (6) to the gaming server (2) for storage on an associated storage device (not shown)

The simulation program also causes a "Deal" icon to be displayed on the display monitor (4) that, when activated by the player by means of the pointing device (5), begins a playing phase of the game in which all the player's hands on which he has placed ante wagers, and the dealer's hand, are dealt by the gaming server (2) and displayed by the simulation program on the display monitor (4). A first one of the playing cards in the dealer's hand is displayed face-up, while the remaining cards are displayed facedown. Activation of the "deal" icon by the player causes a message to be transmitted to the gaming server (2) across the communication network (6), which causes the execution of the event generation program on the gaming server to randomly select playing cards making up the player's and the dealer's hands. Each hand, whether belonging to the player or to the dealer, is selected randomly by the event generation program from an independent, identically distributed, logical deck of playing cards. The gaming server transmits the composition of the randomly selected hands across the communication network (6) back to the computer workstation (3) where the simulation program displays the individual playing cards in the player and dealer's dealt hands. The simulation program displays the cards as being dealt from a card shoe and all the cards are dealt simultaneously in order to speed up play and to provide a fast-paced game.

During this playing phase of the game, the simulation program also displays "Play" and "Fold" icons on the display monitor (4) that can be selectively activated by the player to make desired game play decisions, that is, whether to play or to fold, respectively, each one of the multiple hands dealt to the player. The simulation program causes the cards of any dealt hand that is folded by the player to be displayed in low lighting to indicate that that particular hand is no longer in play. The player is required to make a main wager on each hand that he does not fold, the main wager being equal to twice the corresponding ante wager. As is the case with ante wagers, data relating to the size of each such main wager made by the player is transmitted by the computer workstation (3) across the communication network (6) to the gaming server (2) for storage on the storage device (not shown).

Once the player has either folded or elected to play each one of the multiple dealt hands, the simulation program causes the face down cards in the dealer's hand to be displayed. The dealer's face down cards are revealed slowly, one at a time, in order to heighten tension and excitement of the game. The player's hands that are determined as being winning hands are highlighted on the display monitor (4) and the gaming server (2) settles the player's ante and main wagers as described above.

The gaming server (2) transmits the player's credit account balance across the communication network (6) to the computer workstation (3) from time to time. The simulation program displays this balance to the player in real time on the display monitor (4) to indicate a quantity of credit that is available to the player for playing the game. The credit balance is adjusted with each turn of the game in accordance with wagers placed and won or lost by the player.

Once the player's ante and main wagers have been settled as described above, the turn of the game of Caribbean Stud poker is complete and the player may begin a further turn of the game by making other ante wagers one or more of the bet placement locations displayed on the display monitor (4).

In this embodiment of the invention, the player is not required to handle physical playing cards of any kind. The playing cards on which the game is based are displayed electronically, thereby eliminating the problem of potential card swapping described above. The embodiment also allows multiple players, each having their own computer workstation (3) and associated display monitor (4) to communicate with the gaming server (2) to each play, at the same time, multiple hands of Caribbean Stud poker.

In order that the invention may be more fully understood, a number of examples of player and dealer hands, and accompanying wagers, are discussed below.

Example 1

The player makes an ante wager of 1 unit and the player is dealt a Royal Flush. The player decides to play the hand, requiring a main wager of 2 units. The dealer's hand does not qualify. In this situation, the main wager of 2 units is returned to the player, together with twice the ante wager. The net profit to the player on this hand is thus 1 unit.

Example 2

The player makes an ante wager of 1 unit and contains none of the above listed card combinations. The player nevertheless decides to play the hand, requiring a main wager of 2 units. The dealer's hand qualifies. The player thus loses both the ante and the main wagers, resulting in a net loss of 3 units.

Example 3

The player makes an ante wager of 1 unit and the player is dealt an Ace-King. The player decides to play the hand, requiring a main wager of 2 units. The dealer's hand does not qualify. In this instance, the main wager of 2 units is returned to the player, together with twice the ante wager. The net profit to the player, as in Example 1, is 1 unit.

Example 4

The player makes an ante wager of 1 unit and the player is dealt an Ace-King. The player decides to play the hand, requiring a main wager of 2 units. The dealer's hand also contains an Ace-King. The remaining cards in the player's and dealer's hands are compared and the highest-ranking card is contained in the player's hand. The player thus wins the hand and is paid twice the ante wager together with twice the main wager, resulting in a net profit of 3 units.

Example 5

The player makes an ante wager of 1 unit and is dealt a Royal Flush. The player decides to play the hand, requiring a main wager of 2 units. The dealer's hand qualifies, but does not contain a Royal Flush. The player thus wins the hand and is paid twice the ante wager, together with 1000 times the main wager, totalling 2002 units and resulting in a net profit of 1999 units.

The technical problem solved by this invention is that of transforming the game of Caribbean Stud poker into a multiplayer game and, further, also enabling each one of such multiple players to play, simultaneously, multiple hands of Caribbean Stud poker. At the same time, the embodiment of the system described above eliminates the possibility of fraud by such players. This is made possible by providing that the multiple hands of the game are played with electronically generated playing cards instead of physical ones. In addition, the invention removes any element of player skill from such a multiple hand game by ensuring that any hand is dealt from a separate deck of cards, thereby transforming the game into one of pure chance.

The invention therefore provides a novel variation of a conventional game of Caribbean Stud poker that will enable one or more players to play multiple simultaneous hands in a turn of the game.

The invention claimed is:

1. A method for gaming, which includes the steps of:

a gaming server dealing multiple concurrent hands of playing cards to a player in a turn of a game of Caribbean Stud poker, wherein each one of the multiple concurrent hands of playing cards is dealt from a separate deck of playing cards, all of the separate decks of playing cards having an identical composition; and the gaming server dealing a hand of playing cards associated with a dealer, wherein the hand of playing cards associated with the dealer is dealt from a further separate deck of playing cards, wherein the hand of playing cards associated with the dealer is dealt prior to dealing the multiple concurrent hands of playing cards to the player, and wherein the playing cards contained in the hand of playing cards associated with the dealer are removed from each of the separate decks of playing cards prior to dealing the multiple concurrent hands to the player.

2. A method as claimed in claim 1 in which each one of the separate decks of playing cards is a single deck containing 52 playing cards at most.

3. A method as claimed in claim 1 in which each one of the multiple concurrent hands of playing cards to the player is a poker hand consisting of five dealt playing cards.

4. A method as claimed in claim 1 that includes the further step of dealing multiple concurrent hands of playing cards to each one of a plurality of different players.

5. The method of claim 1, wherein the hand of playing cards associated with the dealer consists of five playing cards, wherein a first card of the hand of playing cards associated with the dealer is dealt face up and the remaining four cards of the hand of playing cards associated with the dealer are dealt face down, and wherein the multiple concurrent hands of playing cards to the player are dealt face down.

6. The method of claim 1, further comprising:

prior to dealing the hand of playing cards associated with the dealer, the player placing a separate ante wager on an outcome of each one of the multiple concurrent hands of playing cards to the player;

after dealing the multiple concurrent hands of playing cards to the player, for each of the multiple concurrent hands of playing cards to the player, the player either forfeiting the ante wager associated with that hand of playing cards to the player or placing a main wager associated with that hand of playing cards to the player; and revealing each of the playing cards in the hand of playing cards associated with the dealer and the playing cards in the multiple concurrent hands of playing cards to the player for which a main wager has been placed so as to determine a winner of each of the multiple concurrent hands of playing cards to the player for which a main wager has been placed.

7. A method of operating a gaming server, comprising the steps of:

the gaming server randomly selecting multiple concurrent hands of playing cards for a player playing a turn of a game of Caribbean Stud poker, wherein each one of the multiple concurrent hands of playing cards is selected randomly from a separate deck of playing cards, all of the separate decks of playing cards having an identical composition;

the gaming server randomly selecting a hand of playing cards associated with a dealer, wherein the hand of playing cards associated with the dealer is randomly selected from a further separate deck of playing cards, wherein the hand of playing cards associated with the dealer is randomly selected prior to randomly selecting the multiple concurrent hands of playing cards for the player;

prior to randomly selecting the multiple concurrent hands of playing cards for the player, the gaming server removing the playing cards contained in the hand of playing cards associated with the dealer from each of the separate decks of playing cards; and the gaming server transmitting to a player station via a communication network a signal containing data representative of the selected multiple concurrent hands of playing cards and the hand of playing cards associated with the dealer.

8. A method as claimed in claim 7 in which each one of the separate decks of playing cards is a single deck containing 52 cards at most.

9. A method as claimed in claim 7, wherein each one of the multiple concurrent hands of playing cards for the player is a poker hand consisting of five randomly selected playing cards.

10. A method as claimed in claim 7 that includes the additional step of randomly selecting multiple concurrent hands of playing cards for each one of a plurality of different players.

11. A method of operating a client computer, comprising the steps of:

the client computer transmitting to a gaming server via a communication network a request to randomly select multiple concurrent hands of playing cards for a player playing a turn of a game of Caribbean Stud poker, wherein each one of the multiple concurrent hands of playing cards is selected randomly from a separate deck of playing cards, all of the separate decks of playing cards having an identical composition;

the client computer requesting the gaming server to randomly select a hand of playing cards associated with a dealer, wherein the hand of playing cards associated with the dealer is randomly selected from a further separate deck of playing cards;

the client computer receiving from the gaming server via the communication network a response containing data representative of the selected multiple concurrent hands and the hand associated with the dealer; and the client computer displaying the selected multiple concurrent hands of playing cards and the hand of playing cards associated with the dealer as part of a simulation of a game of Caribbean Stud poker, wherein the hand of playing cards associated with the dealer is randomly selected prior to randomly selecting the multiple concurrent hands of playing cards for the player, and wherein prior to randomly selecting the multiple concurrent hands of playing cards for the player, removing the playing cards contained in the hand of playing cards associated with the dealer from each of the separate decks of playing cards.

12. A system for concurrent gaming, comprising:

a gaming server operable under program control to regulate the progress of a game of Caribbean Stud poker;

a player station remote from the gaming server, the player station being operable to display a simulation of a game of Caribbean Stud poker;

a communication network providing communication between the gaming server and the player station;

dealing means instructable to deal multiple concurrent hands of playing cards to a player in a turn of the game of Caribbean Stud poker, wherein each one of the multiple concurrent hands of playing cards to the player is dealt from a separate deck of playing cards, all of the separate decks of playing cards having an identical composition, and to deal a hand of playing cards associated with a dealer, the player station being responsive to the dealing means to display the multiple concurrent hands of playing cards to the player and the hand of playing cards associated with the dealer as part of the simulation, wherein the dealing means deals the hand of playing cards associated with the dealer from a further separate deck of playing cards, wherein the dealing means deals the hand of playing cards associated with the dealer prior to dealing the multiple concurrent hands of playing cards to the player, and wherein the dealing means removes the playing cards contained in the hand of playing cards associated with the dealer from each of the separate decks of playing cards prior to dealing the multiple concurrent hands of playing cards to the player.

13. A system as claimed in claim 12 in which each one of the separate decks of playing cards is a single deck containing 52 playing cards at most.

14. A system as claimed in claim 12 in which each one of the multiple concurrent hands of playing cards to the player is a poker hand consisting of five dealt playing cards.

15. A system as claimed in claim 12 in which the dealing means deals multiple concurrent hands of playing cards to each one of a plurality of different players.

16. A method carried out by a client computer, the method comprising:

the client computer receiving data representative of (i) a composition of multiple, randomly selected, concurrent hands of playing cards for a player playing a turn of a game of Caribbean Stud poker, wherein each one of the multiple concurrent hands of playing cards is randomly selected from a separate deck of playing cards, all of the separate decks of playing cards having an identical composition, and (ii) a further hand of playing cards associated with a dealer, wherein the hand of playing cards associated with the dealer is randomly selected from a further separate deck of playing cards; and the client computer displaying on a display monitor the multiple, randomly selected, concurrent hands of playing cards and the further hand of playing cards associated with the dealer, wherein the further hand of playing cards associated with the dealer is randomly selected prior to randomly selecting the multiple concurrent hands of playing cards for the player, and wherein prior to randomly selecting the multiple concurrent hands of playing cards for the player, removing the playing cards contained in the hand of playing cards associated with the dealer from each of the separate decks of playing cards.

* * * * *